US006588413B2

(12) United States Patent
Nagasue

(10) Patent No.: US 6,588,413 B2
(45) Date of Patent: Jul. 8, 2003

(54) BLOWGUN

(75) Inventor: Yoichi Nagasue, Saitama (JP)

(73) Assignee: Shogo Ohnishi, Saitama (JP); part interest ( * ) Notice: Subject to any disclaimer, the term of this patent is extended or adjusted under 35 U.S.C. 154(b) by 0 days.

(21) Appl. No.: 10/158,173

(22) Filed: May 29, 2002

(65) Prior Publication Data

US 2002/0179076 A1 Dec. 5, 2002

(30) Foreign Application Priority Data

Jun. 4, 2001 (JP) ..... 2001-167695

(51) Int. Cl.[7] ..... F41B 1/00
(52) U.S. Cl. ..... 124/62
(58) Field of Search ..... 124/62, 41.1, 44.7, 124/45; D22/102

(56) References Cited

U.S. PATENT DOCUMENTS

| | | | | | |
|---|---|---|---|---|---|
| 278,005 | A | * | 5/1883 | Fredericks | 124/62 |
| 429,499 | A | * | 6/1890 | Bunsen | 124/62 |
| 565,423 | A | * | 8/1896 | Beck | 124/62 |
| 1,152,447 | A | * | 9/1915 | Sproull | 124/62 |
| 2,427,490 | A | * | 9/1947 | Berryayarza | 124/62 |
| 2,580,613 | A | * | 1/1952 | Seibel | 124/62 |
| 2,888,003 | A | * | 5/1959 | Swanson | 124/62 |
| 3,220,398 | A | * | 11/1965 | Martin | 124/62 |
| 3,388,696 | A | * | 6/1968 | Hoverath | 124/62 |
| 3,433,210 | A | * | 3/1969 | Schintz | 124/62 |
| 3,685,828 | A | * | 8/1972 | Getgey et al. | 273/356 |
| 3,735,748 | A | * | 5/1973 | Gaylord | 124/62 |
| 3,837,107 | A | * | 9/1974 | Swaim et al. | 42/105 |
| 4,054,120 | A | * | 10/1977 | Foley | 124/62 |
| 4,133,452 | A | * | 1/1979 | Wiltrout | 221/185 |
| 4,419,978 | A | * | 12/1983 | Loftus | 124/62 |
| D282,765 | S | * | 2/1986 | Shipman | D22/102 |
| D346,635 | S | * | 5/1994 | Vang | D22/102 |
| 5,544,642 | A | * | 8/1996 | Guthrie | 124/62 |
| 5,718,214 | A | * | 2/1998 | Altman et al. | 124/62 |
| 5,850,826 | A | * | 12/1998 | Guthrie | 124/62 |

FOREIGN PATENT DOCUMENTS

| | | | | |
|---|---|---|---|---|
| DE | 3150771 | * | 6/1983 | |
| DE | 3724548 C1 | * | 6/1988 | F41B/1/00 |
| DE | 3724548 | * | 6/1988 | |
| JP | 02000180094 | * | 6/2000 | |
| JP | 02000205788 | * | 7/2000 | |

* cited by examiner

*Primary Examiner*—Michael J. Carone
*Assistant Examiner*—Troy Chambers
(74) *Attorney, Agent, or Firm*—Robert W. J. Usher

(57) ABSTRACT

A blowgun comprises cylindrical front and rear blowpipes 2 and 4, which are connected with each other by a connection member 3, a handle member 5 attached to the rear blowpipe 4, a collimator composed of a front sight 6 and a rear sight 7, and a mouthpiece 8. The front sight 6 is provided on the front blowpipe 2 while the rear sight 7 is provided at the top of the handle member 5. The mouthpiece 8, which has a blow inlet 8*b*, is connected to the rear opening of the rear blowpipe 4. The blow inlet of the mouthpiece is offset from the connection part of the mouthpiece that is attached to the rear opening of the blowpipe, so that a user, while he is collimating the blowpipe toward a target by looking through the collimator, can touch the blow inlet by the mouth and blow air to eject a dart, which is inserted and set in the blowpipe beforehand.

9 Claims, 4 Drawing Sheets

(A)

(B)

BLOWGUN

FIELD OF THE INVENTION

The present invention relates to a blowgun that comprises a barrel and a conical dart, which is put in the barrel and shot from a front end thereof by a breath blown in at a rear end thereof.

BACKGROUND OF THE INVENTION

Such a blowgun, which comprises a cylindrical blowpipe, i.e., a barrel, has been well-known, and there is a game or competition in which blowguns are used. In such a game, each participant holds the rear end of the blowpipe by the mouth, aims the front end of the blowpipe toward a target and blows a dart out from the front end of the blowpipe, competing for a best accuracy of hits.

In the competition, a contestant needs to hold the rear end of the blowpipe by the mouth. While the contestant is holding the blowpipe by the mouth, he is in a state of looking slantingly down at the blowpipe, so it is difficult to confirm the direction of the blowpipe by the eyes. Each contestant must aim the blowpipe intuitionally or on a basis of experience before blowing off a dart. Therefore, the accuracy to hit a target is greatly influenced by the contestant's intuition and experience. This is a reason why inexperienced persons are hesitant to participate in blowgun games, so people who are participating in such games tend to be mainly blowgun maniacs.

SUMMARY OF THE INVENTION

It is an object of the present invention to provide a blowgun whose blowpipe has a collimator with which the blowgun can be aimed at a target before shooting a dart.

A blowgun according to the present invention comprises a cylindrical blowpipe, a collimator, which is provided on the blowpipe, and a mouthpiece with a blow inlet, the mouthpiece being attached and connected to the rear opening of the blowpipe. The blow inlet of the mouthpiece is offset from the part of the mouthpiece that is attached to the rear opening of the blowpipe, so that a user, while he is collimating the blowpipe toward a target by looking through the collimator, can touch the blow inlet by the mouth and blow air to eject a dart, which is inserted and set in the blowpipe beforehand. The collimator may comprise a front sight, which is provided upward and outward on the front side of the blowpipe, and a rear sight, which is provided upward and outward on the base side of the blowpipe.

With this blowgun, while the user is touching the blow inlet of the mouthpiece by the mouth, he can collimate the blowgun toward the target by looking through the collimator. While he is keeping the blowgun in this collimated condition, he exhales a breath (air) sharply. As the mouthpiece is connected to the rear end of the blowpipe, the air blown into the mouthpiece rushes into the blowpipe, ejecting the dart out of the blowpipe to the target. As the dart is shot in a collimated condition, the accuracy of hits on the target according to the present invention is much higher than that achievable by a prior-art blowgun. Therefore, with a blowgun according to the present invention, even an inexperienced person can participate in and enjoy a blowgun game.

According to another feature of the present invention, a blowgun comprises a cylindrical blowpipe and a collimator, which is provided on the blowpipe. The collimator is fixed on the blowpipe with an offset upward from the center of the blowpipe by an appropriate distance. In this design, when the user touches the rear opening of the blowpipe by the mouth, the collimator is positioned exactly in front of the eyes of the user.

With this blowgun, while the user is touching the rear opening of the blowpipe by the mouth, he can collimate the blowpipe toward a target with the collimator, which is in front of the eyes of the user. While he is keeping the blowgun in this collimated condition, he exhales a breath (air) sharply into the rear end (blow inlet) of the blowpipe, ejecting a dart out of the blowpipe to the target. As the dart is shot in a collimated condition, this blowgun also improves greatly the accuracy of hits on the target.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings, which are given by way of illustration only and thus are not limitative of the present invention.

DESCRIPTION OF THE PREFERRED EMBODIMENTS

Figure 1:
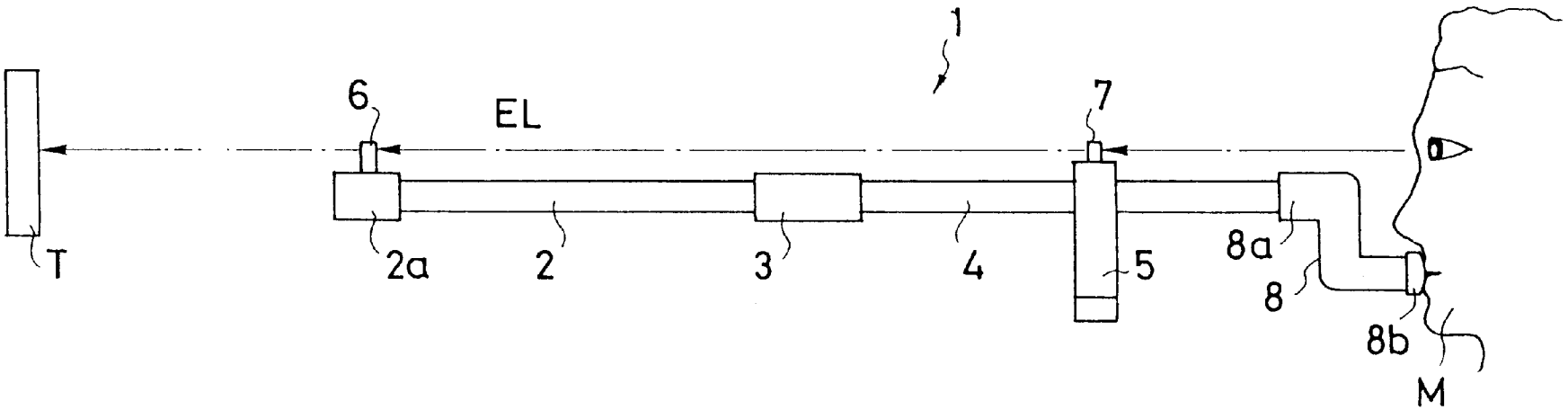
FIG. 1 is a side view of a blowgun according to the present invention.
Figure 2:
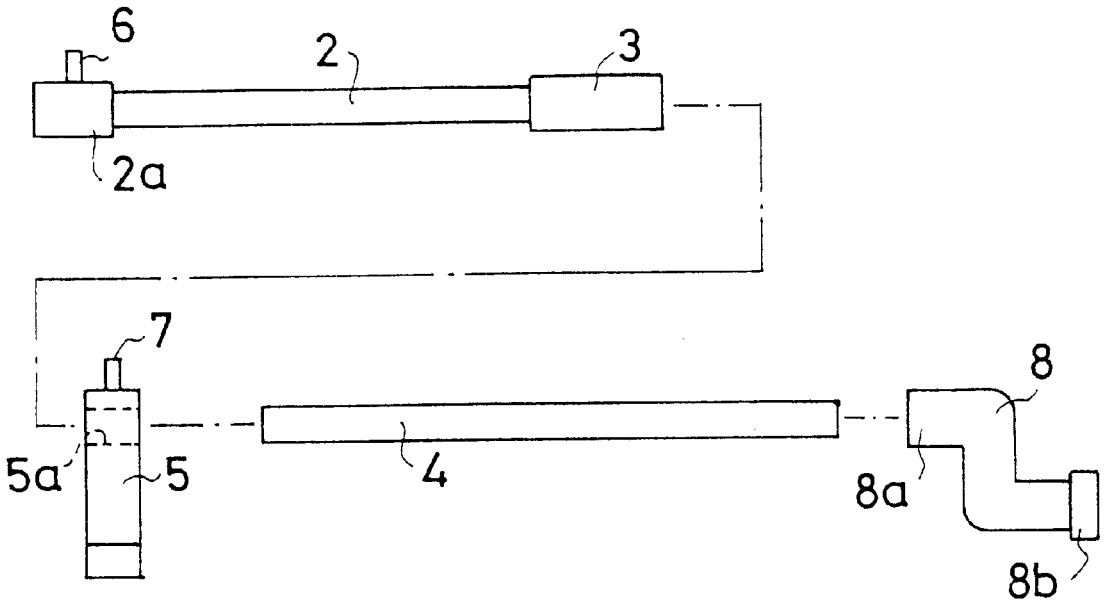
FIG. 2 is an exploded view of the blowgun.

In reference to the drawings, preferred embodiments according to the present invention are described hereafter. FIG. 1 shows the construction of a blowgun 1 according to the present invention, and FIG. 2 shows the components of the blowgun. The blowgun 1 mainly comprises a front blowpipe 2, a rear blowpipe 4, a handle member 5 and a mouthpiece 8. The front blowpipe 2 is provided at the front part thereof with a front ring 2*a* having a front sight 6 and is provided at the rear part thereof with a connection ring 3. When the rear blowpipe 4 is inserted into and fit in the connection ring 3 of the front blowpipe 2, the front blowpipe 2 and the rear blowpipe 4 are connected with each other as a long cylindrical blowpipe which extends with a unified axis. In other words, the blowgun 1 is easily assembled and disassembled for portability. When the rear blowpipe 4 is taken apart from the front blowpipe 2, the blowgun 1 is in disassembled condition and easy to carry. Before the blowgun 1 is to be used, the rear blowpipe 4 is connected with the front blowpipe 2 through the connection ring 3.

The handle member 5 comprises a rear sight 7 at the top part thereof and an insertion bore 5*a*, which is a through hole extending in the front and rear direction. As shown in FIG. 1, the rear blowpipe 4 is inserted into the insertion bore 5*a* to assemble the blowgun. The handle member 5 itself is held with a hand when a user sets the blowgun.

The mouthpiece 8 is a cylindrical hollow member which is bent in a crank figure as shown in the drawing. It comprises a front insertion-bore part 8*a*, which part removably receives the rear end of the rear blowpipe 4 inserted therein. The rear end of the mouthpiece 8, which extends downward and rearward in a crank figure, is provided with a mouth-touching part 8*b*. As shown in FIG. 1, a user M touches the mouth-touching part 8*b* by the mouth and exhales a breath (air) sharply into the mouthpiece 8.

As the mouthpiece 8 is formed in a crank figure, the mouth-touching part 8*b* is offset from the front insertion-bore part 8*a*, which is positioned at the axis of the rear blowpipe 4. The amount of this offset is determined such that the user touching the mouth-touching part 8*b* by the mouth can look at the front sight 6 through the rear sight 7. In other words, the direction of sight EL of the user shall match the line that passes through the front sight 6 and the rear sight 7. In this way, the front sight 6 and the rear sight 7 function as a collimator.

For the blowgun 1 to be used for shooting, at first, the mouthpiece 8 is removed from the blowgun 1. In this condition, a conical dart A (refer to FIG. 3A) is inserted into the rear blowpipe 4 through the rear end thereof, and then the mouthpiece 8 is attached again. For aiming the blowgun 1, while the user M is touching the mouth-touching part 8*b* of the mouthpiece 8 by the mouth and looking at the front sight 6 through the rear sight 7, he tries to collimate the blowgun 1 by orienting it so that a target T shall be positioned on the line extending and passing through the front sight 6 and the rear sight 7. While he is keeping the blowgun 1 in this aimed condition, he exhales a breath sharply. In this instance, the air blown into the mouthpiece 8 flows into the rear blowpipe 4, and the dart in the rear blowpipe 4 is ejected out of the front end of the front blowpipe 2 toward the target T. As the dart is shot in a condition where the blowgun 1 is collimated with the collimator, i.e., the front sight 6 and the rear sight 7, the accuracy of hits on the target is high. As a result, even beginners or inexperienced persons can participate in and enjoy blowgun games.

In the above described blowgun, the blowpipe comprises two parts, but it can be a one-piece blowpipe. Furthermore, the construction of the collimator is not limited to that described in the above embodiment. Instead of the front sight and the rear sight, a scope-like collimator can be provided on the blowpipe.

Figure 3:
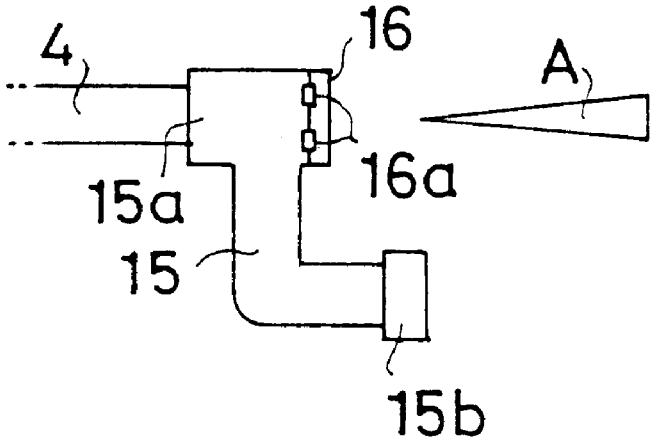
FIGS. 3A and 3B are partial views showing modifications provided to the blowgun.
Figure 3:
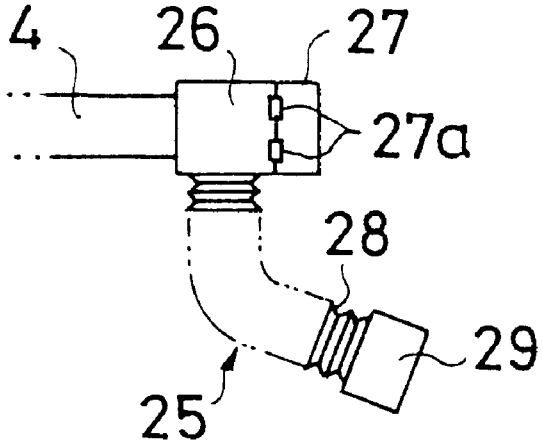

In the above embodiment, the mouthpiece 8 is removed to expose the rear end of the rear blowpipe for insertion of a dart. This design necessitates the removal of the mouthpiece 8 each time when a dart is to be set in the blowpipe. To avoid this inconvenience, the crank-like mouthpiece 15 can be designed with a lid 16, which is attached pivotally to the mouthpiece 15 with a hinge 16*a* as shown in FIG. 3A. In this design of the mouthpiece 15, the rear end of the front insertion-bore part 15*a*, whose front end receives and fits with the rear blowpipe 4, is open, and this opening is covered with the lid 16. In this construction, the lid 16 is opened for loading a dart. After a dart A is inserted into the rear blowpipe 4, the lid 16 is closed. In this closed condition, the user touches the mouth-touching part 15*b* by the mouth and exhales a breath sharply to eject the dart. This design makes the insertion of a dart simpler.

In the first embodiment of the mouthpiece 8, the amount of offset of the mouth-touching part 8*b* from the front insertion-bore part 8*a* is fixed or constant. However, the amount of offset required is different for each individual user M. For this reason, the mouthpiece may be designed as shown in FIG. 3B. This mouthpiece 25 comprises an attaching part 26, which is attached to the rear blowpipe 4, a flexible hose 28, which is connected to the attaching part 26, and a mouth-touching part 29, which is attached to the hose 28. Also, in this design, the rear end of the attaching part 26 is opened and closed with a lid 27, which is connected pivotally to the attaching part 26 with a hinge 27*a*. This construction of the mouthpiece 25 solves the problem of individual difference in the offset amount because the adjustment of the offset is easily performed by the individual user.

Figure 4:
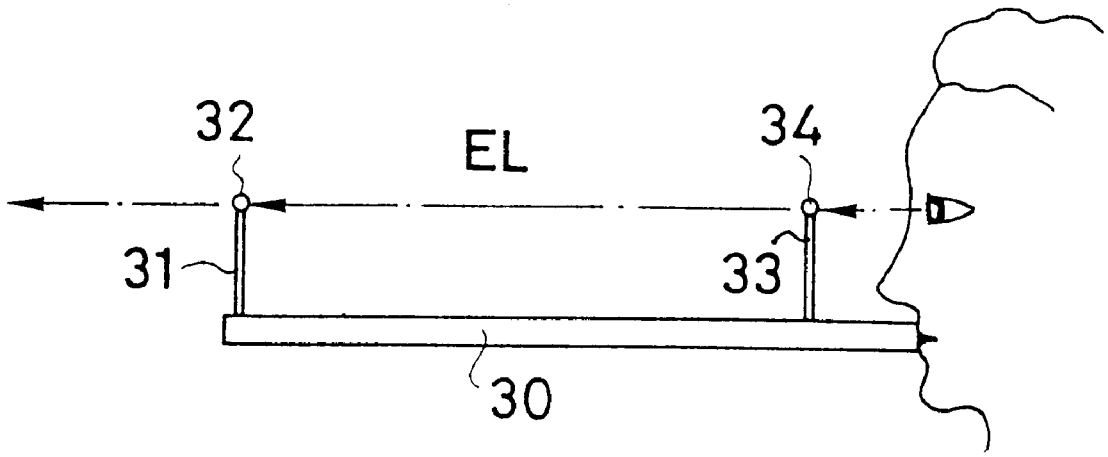
FIG. 4 is a side view of another blowgun according to the present invention.

FIG. 4 shows another embodiment of blowgun according to the present invention. This blowgun comprises a prior-art one-piece blowpipe 30, a front sight 32 and a rear sight 34, both of which are supported on the blowpipe 30 by supporting legs 31 and 33, respectively. By distancing the front and rear sights 32 and 34 with the supporting legs 31 and 33, respectively, away from the blowpipe 30, the user holding the rear end of the blowpipe 30 by the mouth can look at the front sight 32 through the rear sight 34. As a result, this blowgun enables the user to shoot a dart in a condition where the blowgun is collimated appropriately to a target.

As described above, according to a feature of the present invention, while the user is touching the blow inlet of the mouthpiece, which is connected to the rear end of the blowpipe, by the mouth, he can collimate the blowgun through a collimator provided on the blowpipe. In this collimated condition, the user exhales a breath (air) sharply into the blow inlet, so the air blown into the mouthpiece flows into the blowpipe, ejecting a dart, which is set in the blowpipe. As the dart is shot in a condition where the blowgun is collimated with the collimator, the accuracy of the blowgun to shoot a dart on a target is higher than that of a prior-art blowgun. This improvement makes inexperienced persons feel easy to participate in blowgun games.

According to another feature of the present invention, a blowgun comprises a cylindrical blowpipe and a collimator, which is provided on the blowpipe. The collimator is offset upward from the axis of the blowpipe by an appropriate distance. As a result, when the user touches the rear opening of the blowpipe by the mouth, the collimator is positioned exactly in front of the eyes of the user. This condition enables the user to collimate the blowgun toward a target with the collimator while he is in a position to shoot a dart with the mouth touching the rear opening of the blowpipe.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A blowgun comprising:

a cylindrical blowpipe;

a collimator, which is provided on said blowpipe; and a mouthpiece with a blow inlet, said mouthpiece being attached and connected to a rear opening of said blowpipe;

an opening at a part of said mouthpiece that faces said rear opening of said blowpipe;

a lid to close and open said opening;

a connection part of said mouthpiece attached to said rear opening wherein:

said blow inlet of said mouthpiece is offset from the connection part of said mouthpiece that is attached to the rear opening of said blowpipe, so that a user, while he is collimating said blowpipe toward a target by looking through said collimator, can touch said blow inlet by his mouth and blow air to eject a dart, which is inserted and set in said blowpipe beforehand, and wherein:

said lid is opened to set a dart in said blowpipe through said rear opening.

2. The blowgun set forth in claim 1, wherein said collimator comprises a front sight, which is provided upward and outward on a front side of said blowpipe, and a rear sight, which is provided upward and outward on a base side of said blowpipe.

3. The blowgun set forth in claim 1, wherein:

said blowpipe comprises a plurality of blowpipe members, which are connected by a connection member; and said blowpipe can be disassembled by removing said connection member.

4. The blowgun set forth in claim 1, wherein:

said mouthpiece is removably attached to a rear end of said blowpipe; and said mouthpiece is removed to open said rear opening of said blowpipe, through which opening, a dart can be set in said blowpipe.

5. The blowgun set forth in claim 1, wherein said blowpipe is provided with a handle member.

6. The blowgun set forth in claim 5, wherein said handle member is provided with a rear sight that constitutes said collimator.

7. The blowgun set forth in claim 1, wherein said blowpipe is provided with a front sight that constitutes said collimator, said front sight being positioned at a front end of said blowpipe.

8. The blowgun set forth in claim 1, wherein said offset of said mouthpiece is adjustable in amount.

9. A blowgun comprising:

a cylindrical blowpipe and a mouthpiece with a blow inlet, said mouthpiece being attached and connected to a rear opening of said blowpipe;

a connection part of said mouthpiece attached to the rear opening;

an opening at a part of said mouthpiece that faces said rear opening of said blowpipe, a lid to close and open said opening;

wherein:

said blow inlet of said mouthpiece is offset from the connection part of said mouthpiece that is attached to the rear opening of said blowpipe, so that a user, while he is collimating said blowpipe toward a target by looking along an axis parallel to and spaced a predetermined distance above a longitudinal axis of said blowpipe, can touch said blow inlet by his mouth and blow air to eject a dart, which is inserted and set in said blowpipe beforehand, wherein:

said lid is opened to set a dart in said blowpipe through said rear opening.

* * * * *